US011673281B2

(12) United States Patent
Zahorski

(10) Patent No.: US 11,673,281 B2
(45) Date of Patent: Jun. 13, 2023

(54) CUTTING AND SNIPPING DEVICE

(71) Applicant: Vance P. Zahorski, Angleton, TX (US)

(72) Inventor: Vance P. Zahorski, Angleton, TX (US)

( * ) Notice: Subject to any disclaimer, the term of this patent is extended or adjusted under 35 U.S.C. 154(b) by 113 days.

(21) Appl. No.: 17/092,225

(22) Filed: Nov. 7, 2020

(65) Prior Publication Data

US 2021/0138670 A1 May 13, 2021

Related U.S. Application Data

(60) Provisional application No. 62/932,339, filed on Nov. 7, 2019.

(51) Int. Cl.

| | |
|---|---|
| ***B26B 11/00*** | (2006.01) |
| ***B26B 13/00*** | (2006.01) |
| ***B26B 13/06*** | (2006.01) |
| ***B26B 1/02*** | (2006.01) |

(52) U.S. Cl.

CPC ..... *B26B 11/005* (2013.01); *B26B 1/02* (2013.01); *B26B 13/005* (2013.01); *B26B 13/06* (2013.01)

(58) Field of Classification Search

CPC ..... B26B 13/00; B26B 13/005; B26B 13/06; B26B 13/12; B26B 13/16; B26B 13/20; B26B 13/22; B26B 13/28; B26B 11/00; B26B 11/005; B26B 11/006; B26B 27/00; A24F 13/24; A24F 13/26

USPC ..... 30/112, 237, 254, 255, 280, 282, 287; D8/55, 57, 98

See application file for complete search history.

(56) References Cited

U.S. PATENT DOCUMENTS

| | | | | |
|---|---|---|---|---|
| 611,313 | A | 9/1898 | Crandall | |
| 647,862 | A | 4/1900 | McLaughlin | |
| 1,060,773 | A | 5/1913 | Stephen | |
| 1,165,697 | A | 12/1915 | Morrell | |
| 1,379,864 | A | 5/1921 | Gregory | |
| 1,497,077 | A | 6/1924 | Freeman | |
| 1,521,051 | A | 12/1924 | Shiba | |
| 1,935,812 | A * | 11/1933 | Moody | B26B 11/005 30/155 |
| 2,707,828 | A | 5/1955 | Stewart | |
| 4,316,324 | A * | 2/1982 | Cochran | B26B 11/00 30/287 |
| 4,715,121 | A * | 12/1987 | Sugiyama | B26B 13/005 30/253 |

(Continued)

FOREIGN PATENT DOCUMENTS

DE 102006023334 B4 4/2008

*Primary Examiner* — Jason Daniel Prone

(74) *Attorney, Agent, or Firm* — Thomas W. Galvani, P.C.; Thomas W. Galvani

(57) ABSTRACT

A cutting and snipping device includes a housing having a front, an opposed rear, an open mouth at the front, opposed sides extending from the front to the rear and each formed with longitudinal slots, and a head projecting from the rear, wherein a blade set into the head is exposed between the head and the rear of the housing. The device includes scissor arms, each having a cutting edge at a front end, an opposed rear end, and a grip extending between the front end and the rear end. The scissor arms are mounted within the housing for scissored movement with respect to each other and for reciprocal movement with respect to the housing between a forward position in which the cutting edges are advanced out of the mouth and a retracted position in which the cutting edges are retracted within the mouth.

24 Claims, 6 Drawing Sheets

(56) References Cited

U.S. PATENT DOCUMENTS 4,726,140 A 2/1988 Mears
4,730,409 A 3/1988 Mitchell et al.
4,759,127 A * 7/1988 Gingher, Jr. ..... B26B 13/00 30/232
4,783,867 A * 11/1988 Tsao ..... B26B 11/005 30/123
4,791,725 A * 12/1988 Amagaya ..... B26B 13/12 30/255
4,794,692 A * 1/1989 Wang ..... B26B 11/005 30/255
4,823,498 A 4/1989 Banta
4,896,422 A 1/1990 Sheehan et al.
D308,462 S * 6/1990 Komatsu ..... D8/99
D314,606 S 2/1991 Banta
5,025,585 A 6/1991 Powell
5,038,479 A 8/1991 Davis
D325,240 S 4/1992 Ellis
D332,651 S 1/1993 Sugerman
5,182,874 A 2/1993 Powell
5,301,432 A 4/1994 Richardson et al.
5,303,721 A * 4/1994 Bowen ..... A24F 13/20 30/112
5,385,569 A 1/1995 Michael
5,511,262 A * 4/1996 Horng ..... B26B 11/005 30/123
D377,595 S 1/1997 Wiezenthal
D384,974 S * 10/1997 Sawano ..... D8/98
D389,030 S * 1/1998 Wensley ..... D8/55
5,937,523 A * 8/1999 Van Keppel ..... A24F 13/26 30/112
6,018,877 A 2/2000 Greene
6,029,387 A 2/2000 Swor
D435,209 S 12/2000 Parsons et al.
D457,934 S 5/2002 Coq
D463,494 S * 9/2002 Mori ..... D19/65
D474,392 S 5/2003 Lang
D488,532 S 4/2004 Boone et al.
D498,404 S 11/2004 Schmidt
D503,323 S 3/2005 Hasegawa et al.
6,892,456 B2 * 5/2005 Yu Chen ..... B26B 11/00 30/2
D539,318 S 3/2007 Oas
7,377,043 B2 * 5/2008 Tsai ..... B26B 13/16 30/255
D602,324 S * 10/2009 Hancock ..... D8/98
D610,432 S 2/2010 Siegel
D619,674 S 7/2010 Marlin
D628,030 S 11/2010 Mullen et al.
D632,248 S 2/2011 Cacioppo et al.
D636,248 S 4/2011 Still
7,958,639 B2 6/2011 Ireland et al.
D648,203 S * 11/2011 Avery ..... D8/57
D649,001 S 11/2011 Still
D665,869 S 8/2012 Kuhlmann
8,312,580 B2 * 11/2012 Lee ..... B26B 11/00 7/118
D687,287 S 8/2013 Chen
D692,288 S 10/2013 Locklear
D714,611 S 10/2014 Chen
9,289,905 B2 3/2016 Cornell et al.
9,346,177 B2 5/2016 Mayes
D767,710 S 9/2016 Zahorski
9,446,528 B1 9/2016 Zahorski
D767,966 S 10/2016 Standlee
D802,394 S 11/2017 Chen
9,883,694 B2 * 2/2018 Almsberger ..... A24F 13/26
D817,135 S 5/2018 Huesman et al.
9,969,091 B2 5/2018 Jacobs et al.
10,086,521 B2 * 10/2018 Huang ..... B26B 5/005
D835,750 S 12/2018 Zahorski
D859,121 S 9/2019 Zahorski
10,451,831 B2 * 10/2019 Santos ..... G02B 6/25
10,786,912 B2 * 9/2020 Flores ..... B26B 13/22
D902,680 S * 11/2020 Kamiyama ..... D8/57
D913,352 S * 3/2021 Flores ..... D16/135
11,083,218 B1 * 8/2021 Mandeville ..... A24F 13/26
D946,988 S * 3/2022 Zahorski ..... D8/98
11,325,269 B2 * 5/2022 Lazenby ..... B26B 11/005
2002/0124417 A1 9/2002 Cruz
2006/0060040 A1 3/2006 Wichner
2007/0101583 A1 5/2007 Tsai
2009/0000127 A1 * 1/2009 Smith ..... B26B 13/12 30/254
2009/0193947 A1 * 8/2009 Hancock ..... B26B 11/00 30/125
2010/0050690 A1 3/2010 Woodward
2010/0257741 A1 * 10/2010 Lin ..... A24F 13/26 30/112
2010/0299941 A1 12/2010 Marlin
2011/0138631 A1 * 6/2011 Smith ..... B26B 13/22 30/146
2013/0031935 A1 2/2013 Kelleghan
2018/0311804 A1 * 11/2018 Weinberger ..... B26B 11/00
2019/0210206 A1 * 7/2019 Nix ..... B26B 13/22

* cited by examiner

CUTTING AND SNIPPING DEVICE

CROSS-REFERENCE TO RELATED APPLICATIONS

This application claims the benefit of U.S. Provisional Application No. 62/932,339, filed Nov. 7, 2019, which is hereby incorporated by reference.

FIELD

The present specification relates generally to tools, and more particularly to cutting tools.

BACKGROUND

Fishermen use a variety of equipment when they fish. For instance, a fisherman may carry a tackle box or a vest holding a wide variety of flies, hooks, and other devices to be attached to a line. The fisherman might have a small guidebook describing the creek, lake, or other water which he is fishing, or the type of lure and line to be used for a fish feeding in a certain location. The fisherman will likely also carry a variety of lines with him, because he may use numerous lines of varying weights while fishing. In sum, the fisherman carries a great deal of gear. The fisherman often keeps all his gear together so that none of it is forgotten or lost, but keeping and storing it together reduces its portability and is cumbersome.

In addition to all his other gear, the fisherman typically also carries at least one knife and a pair of small scissors or snips. Booth tools can be useful in a number of expected and unexpected ways. Frequently, though, they are used to cut line, perhaps because the line is tangled, about to be tied to a leader or tippet, needs to be freed of a hook, or for other reasons. The fisherman thus frequently pulls his knife or snips out, cuts the line, and then stows the tool. When the fisherman uses his sharp tools over and over, despite the best of intentions, he can grow cavalier, and they can pose a severe danger to himself and others. Further, if the fisherman needs the immediate ability to cut the line without hesitation, he may not have time to reach to his knife or snips. Still further, if the fisherman forgets or loses his knife or snips, he has to resort to especially crude methods for cutting the line, such as using his teeth or a rock, if cutting the line is at all possible.

Quilters, sewers, and others who work with threads and fine fabrics have similar problems. They, too, face a cut risk from the tools they use to cut threads and fine fabrics. An improved device for cutting fishing line, thread, and other fine lines and fabrics is needed.

SUMMARY

A cutting and snipping device includes a housing having a front, an opposed rear, an open mouth at the front, opposed sides extending from the front to the rear and each formed with longitudinal slots, and a head projecting from the rear, wherein a blade set into the head is exposed between the head and the rear of the housing. The device includes scissor arms, each having a cutting edge at a front end, an opposed rear end, and a grip extending between the front end and the rear end. The scissor arms are mounted within the housing for scissored movement with respect to each other and for reciprocal movement with respect to the housing between a forward position in which the cutting edges are advanced out of the mouth and a retracted position in which the cutting edges are retracted within the mouth.

The above provides the reader with a very brief summary of some embodiments described below. Simplifications and omissions are made, and the summary is not intended to limit or define in any way the disclosure. Rather, this brief summary merely introduces the reader to some aspects of some embodiments in preparation for the detailed description that follows.

BRIEF DESCRIPTION OF THE DRAWINGS

Referring to the drawings.

DETAILED DESCRIPTION

Figure 1:
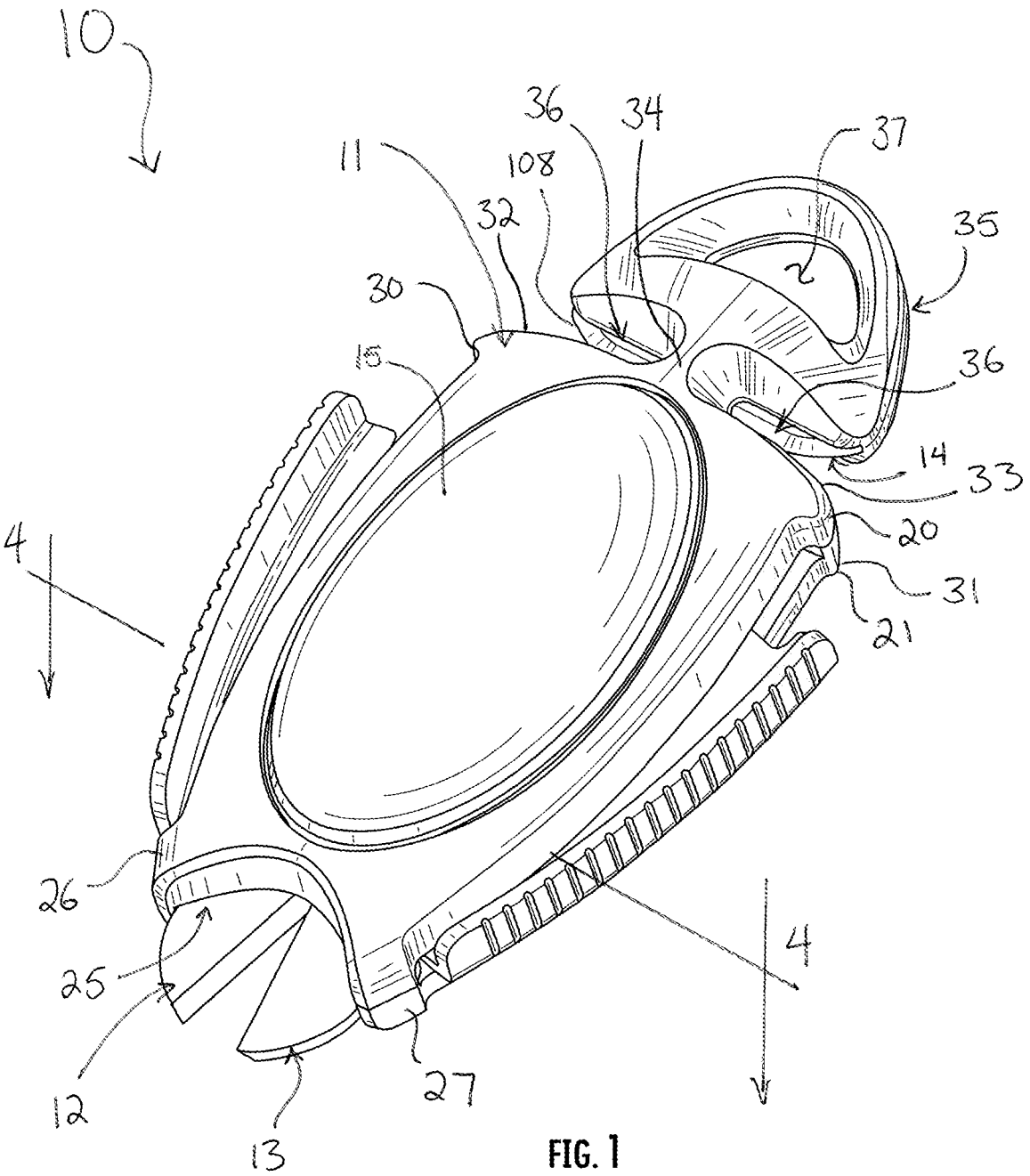
FIGS. 1 and 2 are top and bottom perspective views of a cutting and snipping device.

Reference now is made to the drawings, in which the same reference characters are used throughout the different figures to designate the same elements. Briefly, the embodiments presented herein are preferred exemplary embodiments and are not intended to limit the scope, applicability, or configuration of all possible embodiments, but rather to provide an enabling description for all possible embodiments within the scope and spirit of the specification. Description of these preferred embodiments is generally made with the use of verbs such as "is" and "are" rather than "may," "could," "includes," "comprises," and the like, because the description is made with reference to the drawings presented. One having ordinary skill in the art will understand that changes may be made in the structure, arrangement, number, and function of elements and features without departing from the scope and spirit of the specification. Further, the description may omit certain information which is readily known to one having ordinary skill in the art to prevent crowding the description with detail which is not necessary for enablement. Indeed, the diction used herein is meant to be readable and informational rather than to delineate and limit the specification; therefore, the scope and spirit of the specification should not be limited by the following description and its language choices.

Figure 2:
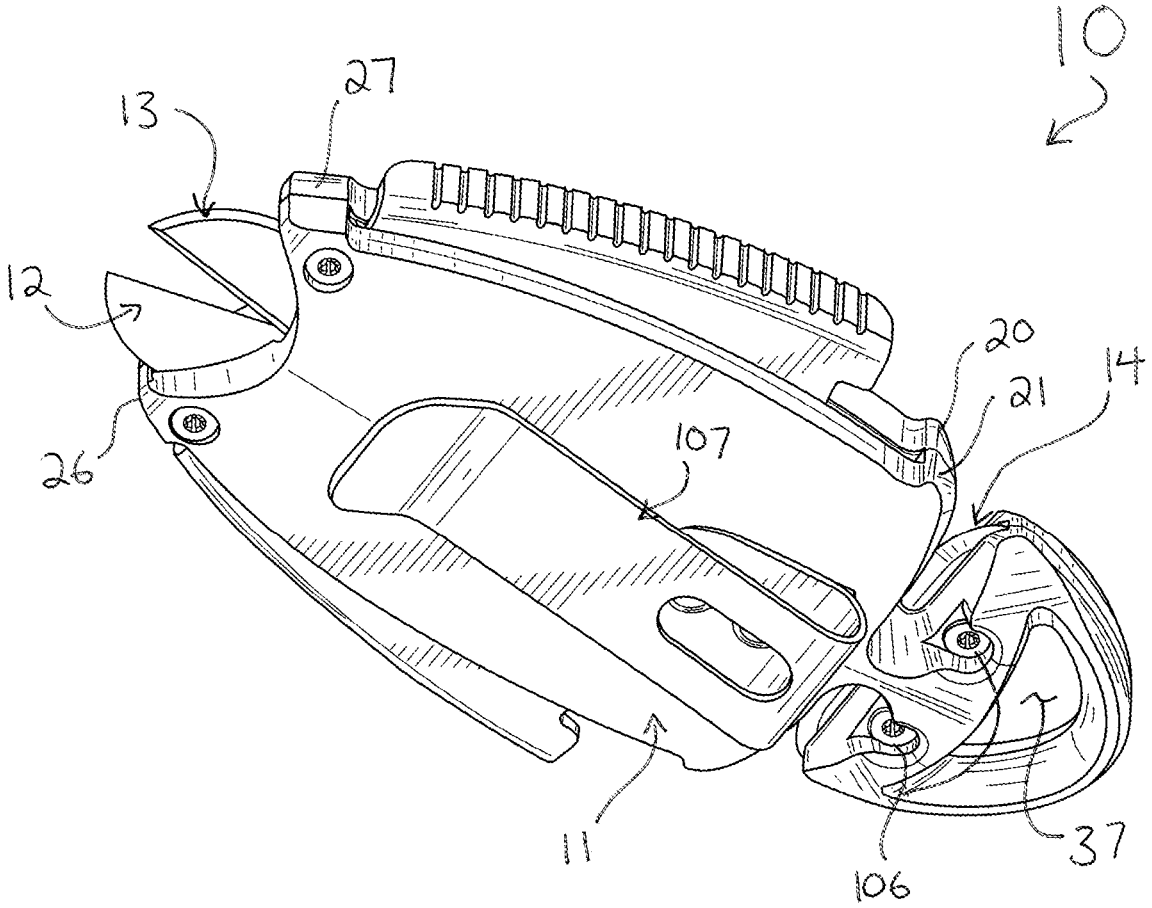

FIGS. 1 and 2 are top and bottom perspective views, respectively, of a cutting and snipping device 10 (hereinafter, the "device 10"). The device 10 has a housing 11 holding a pair of scissored arms 12 and 13 as well as a safety cutting blade 14, thereby providing a user with two different ways to cut fishing line, thread, or another small or thin item or fabric.

Figure 3:
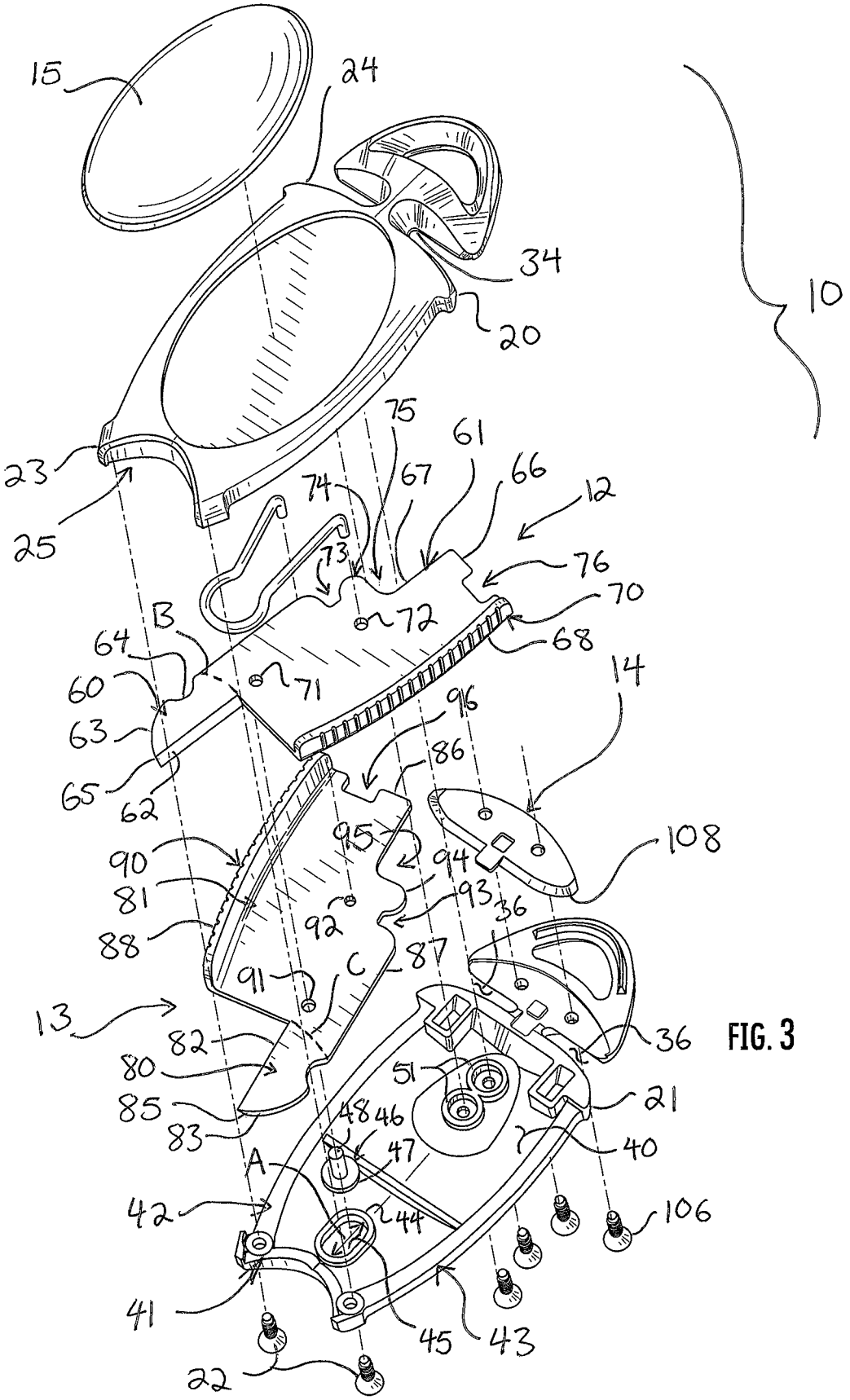
FIG. 3 is an exploded top perspective view of the cutting and snipping device.

Referring now also to FIG. 3, the housing 11 includes a top housing 20 and a bottom housing 21 which are secured to each other by fasteners 22 to form the housing 11. The top and bottom housings 20 and 21 are roughly the same size, each being approximately half the size of the housing 11. The top and bottom housings 20 and 21 are fastened together to retain the scissor arms 13 and the safety blade 14 in the device 10.

The housing 11 has a front 23 and an opposed rear 24. In this disclose, directions, orientations, and arrangements of the device 10 are generally made with reference to this front 23 and rear 24. For example, if the description states that a feature is in front of an element, it should be understood that the feature is closer to the front 23 than is the element. An interior 40 of the housing 11 extends and is defined between the front 23 and the rear 24. A mouth 25 is formed at the front 23. The mouth 25 is open, a concave notch formed into the housing 11 and in communication with the interior 40 thereof. The scissor arms 12 and 13 partially extend through the mouth 25, and they are disposed as such in order to reciprocate and move in pivotal or scissored movement in the mouth 25, as is explained further below. A decorative cover 15 is adhered to the top housing 20.

Opposed sides 26 and 27 extend between the front 23 and rear 24 of the housing 11. The sides 26 and 27 are arcuate, bowing outwardly from the interior 40 in a convex arrangement. Sides 26 and 27 begin at the front 23 at the mouth 25 and extend rearwardly to terminate at shoulders 30 and 31. The housing 11 thus progressively enlarges from the mouth 25 toward the shoulders 30 and 31. The shoulders 30 and 31 are short, small projections extending laterally outward at the rear 24 of the housing 11 from the sides 26 and 27.

Just behind the shoulders 30 and 31 are decks 32 and 33. The decks 32 and 33 are slightly curved, extending laterally inwardly from the shoulders 30 and 31 to a neck 34 of the housing 11. The neck 34 is a thin extension of the housing 11, aligned between the front 23 and rear 24, which connects a head 35 of the device 10 to the rear 24 of the housing 11.

The head 35 projects from the rear 24 of the housing 11. The head 35, in this embodiment, is approximately triangular. It has a wide base opposite the rear 24 of the housing 11. As such, a gap 36 is defined between the head 35 and the rear 24 on both sides of the neck 34. Edges of the blade 14 are exposed in these gaps 36. The head 35 includes a hole 37 through which a lanyard or other leash can be run to attach the device 10 to a vest, article of clothing, or other item.

Figure 4:
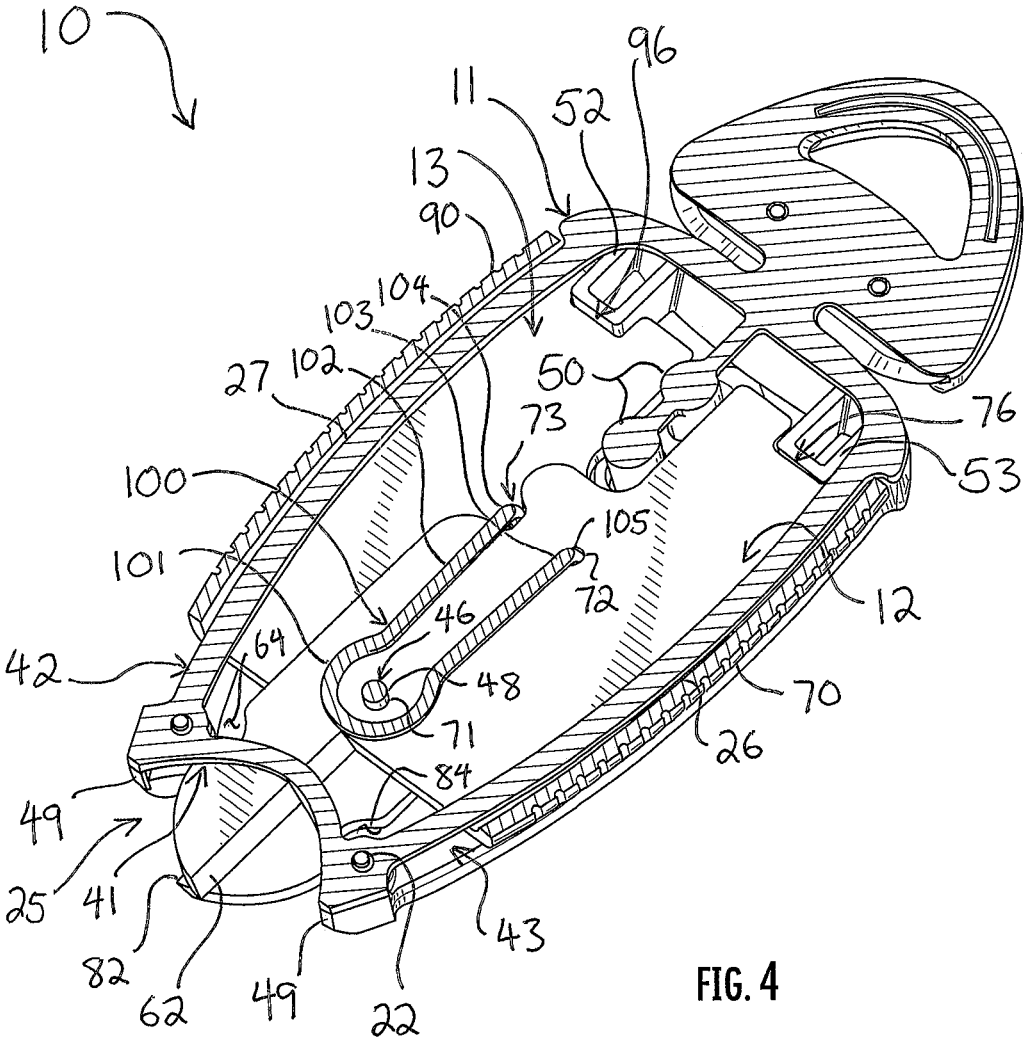
FIGS. 4-6 are top perspective section views taken along the section line 4-4 of FIG. 1, showing movement of scissor arms within the cutting and snipping device through three positions.

Reference is now made primarily to FIGS. 3 and 4. FIG. 4 is a section view taken along the line 4-4 in FIG. 1. Various structures are formed into the housing 11, and in the interior 40 thereof, to enable the device 10 to operate.

A thin slot 41 is formed at the mouth 25. The slot is cooperatively defined by two coextensive and opposing recesses formed into otherwise-mating surfaces of the top and bottom housings 20 and 21. In other embodiments, the slot 41 is defined by a recess formed into only one of the mating surfaces of the top and bottom housings 20 and 21. The slot 41 is aligned between the sides 26 and 27 but does not extend so far: its width is confined by the mouth 25. Indeed, two opposed endwalls 49, marking the beginning of the sides 26 and 27 at the front 23, bound both the mouth 25 and the slot 41. The front ends of the scissor arms 12 and 13 extend through this slot 41.

There are also elongate slots 42 and 43 which extend in and along the sides 26 and 27. The slots 42 and 43 are formed cooperatively from two coextensive and opposing recesses in the mating surfaces of the top and bottom housings 20 and 21. The slots 42 and 43 extend longitudinally, entirely from the endwalls 49 at the mouth 25 to the shoulders 30 and 31 proximate the rear 24 of the housing 11. These slots 42 and 43 accommodate handles of the scissor arms 12 and 13, respectively.

FIG. 3 shows the interior 40 of the housing 11 and the features and elements formed therein. A short, upstanding, oval sidewall 44 extends upward from the bottom housing 21 just behind the mouth 25. The sidewall 44 is formed integrally and monolithically to the bottom housing 21. This sidewall 44 defines a short but elongate channel, path, or track 45 for reciprocal movement of the arms 12 and 13 along the double-arrowed line A. The track 45 carries a guide 46 and limits the movement of the guide 46 in all directions other than a reciprocal one along the line A. The guide 46 includes a disc-shaped base 47 and an upstanding post 48 projecting upward from the base 47. The post 48 is short; it stops short of contacting the top housing 20 in a manner in which movement of the post 48—and hence the guide 46—would be limited. The post 48 is a retaining post and a common pivot point: the scissor arms 12 and 13 are each mounted on the post 48 for pivotal movement with respect thereto, and the scissor arms 12 and 13 move in reciprocal movement with the guide 26 as it moves in the track 45.

Behind the track 45 are two posts 50 formed integrally and monolithically to the top housing 20. The posts 50 extend downward from the top housing 20 are and received in complemental sockets 51 formed integrally and monolithically into the bottom housing 21 and extending upward therefrom. FIG. 4 illustrates the posts 50, FIG. 3 illustrates the sockets 51, and FIG. 6 best illustrates the posts 50 set into the sockets 51. The posts 50 are rigid and disposed centrally in the housing 11 along a centerline between the front 23 and rear 24. Both of the posts 50 are forward of the shoulders 30 and 31. The posts 50 are stop means for limiting movement of the scissor arms 12 and 13, as described below. Here, the posts 50 are cylindrical but they need not be; in other embodiments, the posts 50 have other shapes such as that of a wall, square, triangle, hexagon, etc., or may have an irregular or singular shape.

Just in front of the decks 32 and 33, proximate to the shoulders 30 and 31, are two chocks 52 and 53 enclosed within the interior 40. While the posts 50 are preferably cylindrical, the chocks 52 and 53 are preferably rectangular. The posts 50 are both closer to the front 23 of the housing 11 than are the chocks 53 and 53. The chocks 52 and 53 are formed integrally and monolithically to the top and bottom housings 20 and 21 to form the set of chocks 52 and 53 entirely through the vertical extent of the interior 40. The chocks 52 and 53 are spaced apart from each other and are each formed proximate to and integrally to the rear 24 of the housing 11 as an integral, monolithic, non-separate portion of the housing 11. The chocks 52 and 53 are also proximate the opposing sides 26 and 27.

Figure 5:
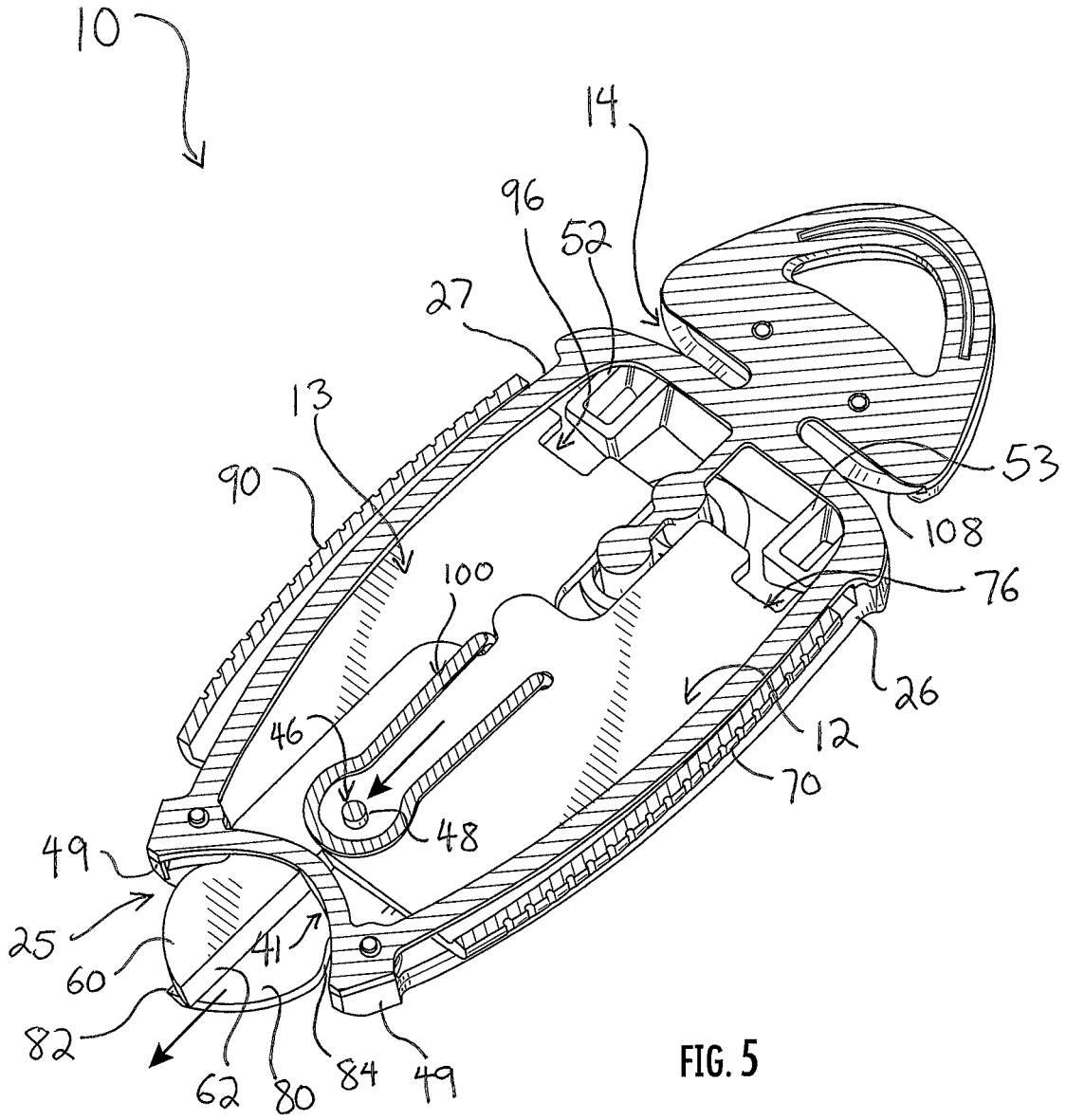
Figure 6:
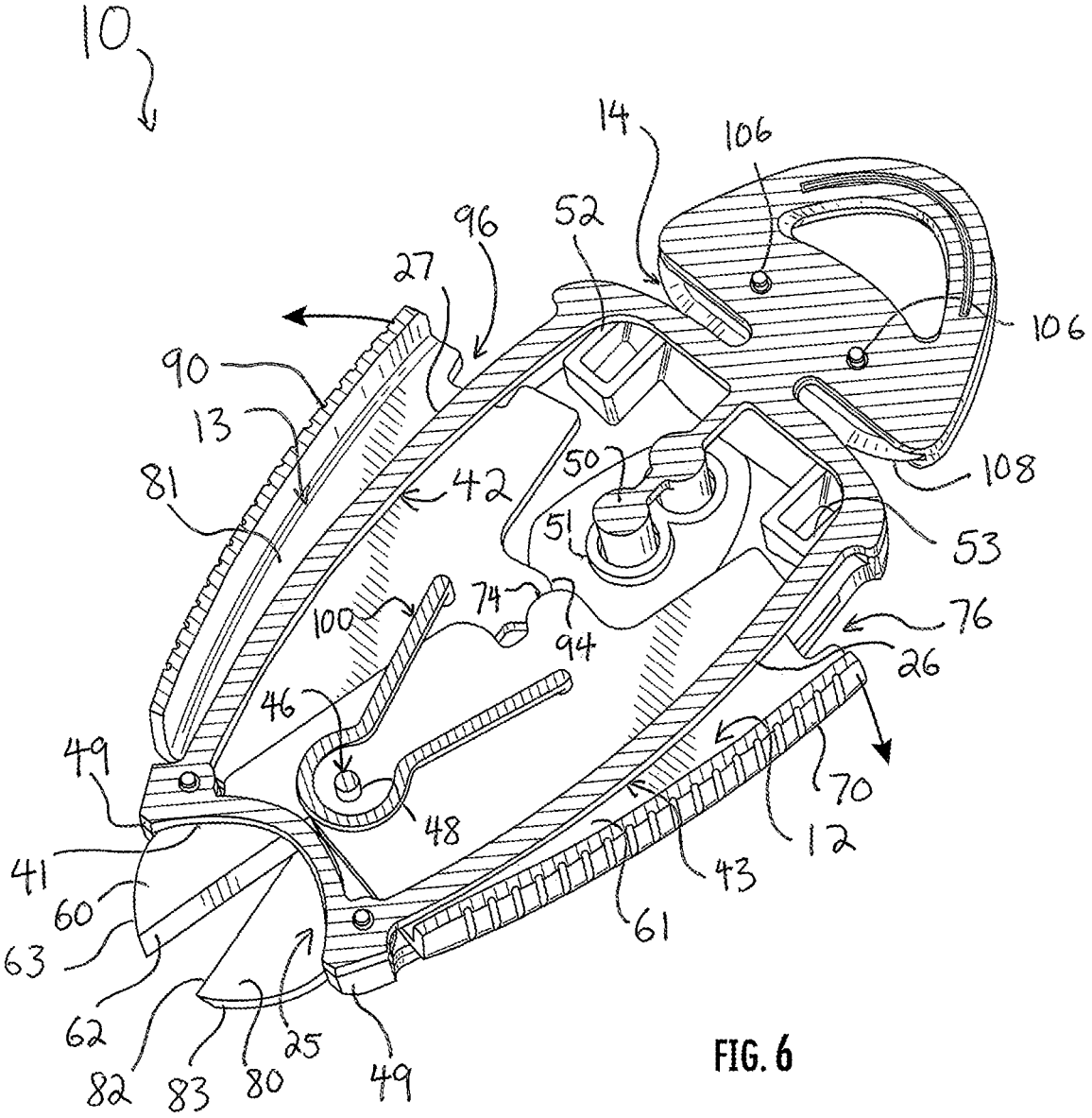

Turning now primarily to FIG. 3, the scissor arms 12 and 13 are captured between the top and bottom housings 20 and 21. They are carried by the housing 11 for movement between a retracted, stowed position (FIG. 4) and an advanced, usable position (FIGS. 5 and 6). In the advanced position, the arms 12 and 13 scissor with respect to each other to open and close so as to be useful for cutting a line or thread.

The arms 12 and 13 are shown in FIG. 3; they are nearly mirror identical to each other. The arm 12 includes opposed front and rear ends 65 and 66, a forward blade 60 at the front end 65, and an opposed rearward handle 61 at the rear end 66. The blade 60 and handle 61 are delineated approximately by the broken line marked with the reference character B in FIG. 3. The blade 60 and handle 61 are formed as a single integral and monolithic piece, preferably formed, stamped, or cut from a single piece of material, such as rigid plastic, ceramic, or metal. The blade 60 has a sharp cutting edge 62, a rounded back 63, and a small notch 64 formed into the back 63. The notch 64 is nearly arcuate and nearly semicircular and directly opposite the edge 62. Behind the blade 60, the handle 61 is wide, extending along a plane between an inner side 67 and an outer side 68. The inner side 67 is a contiguous extension of the back 63 of the blade 60. The outer side 68 turns upward from the plane of the blade 60 to form a short, upstanding sidewall defining a grip 70. The grip 70 is arcuate, bowing outwardly from the inner side 67 in a convex fashion. The sidewall of the grip 70 is formed with a plurality of vertical ribs, oriented transverse to the grip 70, to enhance the friction of the grip 70 to prevent a user's fingers from slipping thereon. In some embodiments, the grip 70 is rubberized or coated with a rubber or other non-slip treatment or element.

When carried within the interior 40, the arm 12 is mounted onto the post 48 of the guide 46. A hole 71 through the handle 61, just behind the blade 60, accommodates the post 48. A second hole 72 is formed behind the hole 71. This second hole 72 receives legs of a spring which biases the scissor arms 12 and 13 apart, as will be described. The inner side 67 of the handle contours around the hole 72; the inner side 67 extends inwardly at a notch 73 proximate the hole 72, a bump 74 then projects outwardly from the behind the notch 73, and then the inner side 67 cuts inward and extends backward to form a large open corner 75 proximate the rear end 66. The rear end 66 of the arm 12 is generally transverse to a line extending from the front end 65 to the rear end 66. A notch 76 is formed into the rear end 66 of the arm 12; the notch 76 is a rectangular recess with two approximately right-angled corners. The notch 76 is sized and shaped to receive the chock 53 stop means in certain positions of the arm 12.

When carried within the interior 40, the arm 12 extends through the slot 41 in the mouth 25 and through the slot 43 in the side 27. The upstanding grip 70 is larger than the slot 43. It is disposed outside the slot 43, such that it cannot be moved through the slot 43. As such, when the arm 12 moves in either reciprocal or scissored movement, the grip 70 remains outside the housing 11, where the user's fingers can hold and manipulate it. The blade 60 is positioned within the slot 41. The blade 60 is thin, and smoothly moves through the slot 41 between retracted and advanced positions with respect to the mouth 25.

Again, the arm 13 is nearly the mirror identical of the arm 12. The arm 12 overlies the arm 13 when carried in the housing 11; indeed, the arm 12 slides directly on top of the arm 13 during pivotal movement of the arms 12 and 13. The arm 13 includes a front end 85 and an opposed rear end 86, and a forward blade 80 at the front end 85 and an opposed rearward handle 81 at the rear end 86. The blade 80 and handle 81 are delineated approximately by the broken line marked with the reference character C in FIG. 3. The blade 80 and handle 81 are formed as a single integral and monolithic piece, preferably formed, stamped, or cut from a single piece of material, such as rigid plastic, ceramic, or metal. The blade 80 has a sharp cutting edge 82, a rounded back 83, and a small notch 84 formed into the back 83. The notch 84 is arcuate, nearly semi-circular, and directly opposite the edge 82. Behind the blade 80, the handle 81 is wide, extending along a plane between an inner side 87 and an outer side 88. The inner side 87 is a contiguous extension of the back 83 of the blade 80. The outer side 88 turns upward from the plane of the blade 80 to form a short, upstanding sidewall defining a grip 90. The grip 90 is arcuate, bowing outwardly from the inner side 87 in a convex fashion. The sidewall of the grip 90 is formed with a plurality of vertical ribs, oriented transverse to the grip 90, to enhance the friction of the grip 90 to prevent a user's fingers from slipping thereon. In some embodiments, the grip 90 is rubberized or coated with a rubber or other non-slip treatment or element.

When carried within the interior 40, the arm 13 is mounted onto the post 48 of the guide 46. A hole 91 through the handle 81, just behind the blade 80, accommodates the post 48. A second hole 92 is formed behind the hole 91. This second hole 92 receives legs of a spring that biases the scissor arms 12 and 13 apart, as is described below. The inner side 87 of the blade 61 contours around the hole 92; the inner side 87 extends inwardly at a notch 93 proximate the hole 92, a bump 94 then projects outwardly from the behind the notch 93, and then the inner side 87 cuts inward and extends backward to form a large open corner 95 proximate the rear end 86. The rear end 86 of the arm 13 is generally transverse to a line extending from the front end 85 to the rear end 86. A notch 96 is formed into the rear end 86 of the arm 13; the notch 96 is a rectangular recess with two approximately right-angled corners. The notch 96 is sized and shaped to receive the chock 53 stop means in certain positions of the arm 13.

When carried within the interior 40, the arm 13 extends through the slot 41 in the mouth 25 and through the slot 42 in the side 26. The upstanding grip 90 is larger than the slot 42 and is disposed outside the slot 42, such that it cannot be moved through the slot 42 into the interior 40. As such, when the arm 13 moves in either reciprocal or scissored movement, the grip 90 remains outside the housing 11, where the user's fingers can hold and manipulate it. The blade 80 is positioned within the slot 41. The blade 80 is thin and smoothly moves through the slot 41 between retracted and advanced positions with respect to the mouth 25.

Turning now to FIGS. 4-6, the arms 12 and 13 are seen carried within the housing 11. In FIG. 4, the arms 12 and 13 are in a first position, defined as a retracted, locked, and closed position of the arms 12 and 13. In FIG. 5, the arms 12 and 13 are in a second position, defined as an advanced, unlocked, and closed position of the arms 12 and 13. In FIG. 6, the arms 12 and 13 are in a third position, defined as an advanced, unlocked, and opened position of the arms 12 and 13. Both of the arms 12 and 13 are structured to pivot about the post 48, into and out of the housing 11, so as to move between these positions. A torsional spring 100 biases the arms 12 and 13 outward into the opened position. The spring 100 includes a round head 101 and opposed legs 102 and 103 extending linearly outward. The head 101 is disposed about the post 48, and it encircles the post 48 nearly entirely but for a small gap between opposed ends of the head, from which the legs 102 and 103 extend outwardly and rearwardly. The legs 102 and 103 terminate in feet 104 and 105. The feet 104 and 105 are oriented transverse to the legs 102 and 103 and are tight fit into the holes 92 and 72 in the arms 13 and 12, respectively. As shown in FIG. 4, the notch 73 accommodates the foot 104 which must extend down below the arm 12 to fit into the hole 92 of the arm 13. Similarly, the foot 105 is sufficiently long that it passes through the hole 72 and projects below the arm 12, and so the notch 93 of the arm 13 accommodates this foot 105. In this way, the arms 12 and 13 are able to come close together in the closed position thereof.

Moreover, the open corners 75 and 95 of the arms 12 and 13 interact with the posts 50 within the housing 11. The open corners 75 and 95 are sized and shaped to receive both of the posts 50; the open corners 75 and 95 have a length corresponding to the combined diameters of the two posts 50. Further, when the arms 12 and 13 are in the closed position thereof, the open corners 75 and 95 are spaced apart from each other by the posts 50. The posts 50 act as stops to the arms 12 and 13; preventing, by contact therewith, the arms 12 and 13 from overlapping too far. The width of the arms 12 and 13 (between the inner and outer sides 67 and 68 and inner and outer sides 87 and 88, respectively) is such that, when the arms 12 and 13 are in the closed position and the inner sides 67 and 87 are received against the posts 50, the upstanding grips 70 and 90 are just outside the slots 42 and 43, such that the grips 70 and 90—each arcuate—are registered with and registered along the arcuate sides 26 and 27.

When the device 10 is arranged as shown in FIG. 4, the arms 12 and 13 are closed and in the locked position. This is because the notches 76 and 96 of the arms 12 and 13 are positioned over the chocks 53 and 52, or, in other words, the chocks 52 and 53 are received within and engage the notches 96 and 76. In this arrangement, the chocks 52 and 53 prevent the arms 12 and 13 from moving apart from each other toward the opened position, and thus prevent the grips 70 and 90 from moving away from the sides 26 and 27 of the housing 11.

Indeed, each chock 52 and 53 prevents both arms 12 and 13 from pivoting. For example, the chock 52 directly engages the notch 96 of the arm 13, thereby preventing the arm 13 from scissored movement. Because the arms 12 and 13 are coupled to each other at the post 46, the arm 12 is prevented from moving forward so long as the arm 13 is held in place. Therefore, so long as the arm 13 is in the retracted position and is engaged with the chock 52, the arm 12 cannot scissor either. The same is true if the arm 12 is engaged with the chock 53.

In this manner, in the closed position of the arms 12 and 13, the arms 12 and 13 are securely held, and inadvertent opening of the arms 12 and 13 is mitigated. The blades 60 and 80 are retracted, such that a portion of the blades 60 and 80 are behind the mouth, and only the very front ends 65 and 85 of the arms 12 and 13 extend beyond the endwalls 49 of the housing 11. The cutting edges 62 and 82 are within the mouth 25 and overlap each other.

When the arms 12 and 13 are in the retracted position thereof, the guide 46 is against the rear portion of the oval sidewall 44 defining the track 45. As noted above, the post 48 of the guide passes through the holes 71 and 91 of the arms 12 and 13. When the arms 12 and 13 are in the device, these holes 71 and 91 are registered and aligned with each other, such that the arms 12 and 13 pivot about the common post 48.

When a person wants to use the snips, he takes his thumb and finger and places them against the grips 70 and 90. He moves the grips 70 and 90 forward. The arms 12 and 13 thus move forward, pushing the post 48 of the guide 46 forward as well. The guide 46 slides forwardly in the track 45; it cannot move in any other direction, and so the arms 12 and 13 are limited in their reciprocal movement in a forward direction from the initial rearward disposition of the guide 46. The user pushes the arms 12 and 13 forward until the base 47 of the guide 46 encounters the front of the sidewall 44 and prevents further forward movement. When the guide 46 is moved fully forward, the arms 12 and 13 are in the advanced position, as shown in FIG. 5. The notches 96 and 76 are now in front of and thus free of the chocks 52 and 53. As such, the chocks 52 and 53 no longer prevent scissored movement of the arms 12 and 13 but rather allow it. The arms 12 and 13, however, are still in the closed position; the user still has fingers on the grips 70 and 90 and holds the arms 12 and 13 closed. The blades 60 and 80 are closed, as well, both projecting out of the mouth 25. In this position, the notches 64 and 84, which were behind the mouth 25 in the retracted position of FIG. 4, are now disposed in the mouth 25, directly in the slot 41, and just inside the endwalls 49. The cutting edges 62 and 82 are advanced out beyond the mouth 25 and overlap each other.

To use the device 10 to snip, the user now releases his hold slightly on the grips 70 and 90, and the spring 100 biases the arms 12 and 13 apart. The arms 12 and 13 swing in scissored movement, apart from each other and away from the sides 26 and 27 of the housing 11, along the arcuate lines shown in FIG. 6. The handles 61 and 81 swing outward, such that the grips 70 and 90 move away from the sides 26 and 27. The handles 61 and 81 slide through the slots 42 and 43 in the sides 26 and 27, and the front ends of the handles 61 and 81 pivot toward the front of the slots 42 and 43, respectively, just behind the endwalls 49. The arms 12 and 13 pivot until they are stopped by interaction of the blades 60 and 61 with the housing 11: the blades 60 and 80 open, moving apart from each other, until their backs 63 and 83 contact the endwalls 49, which limit and prevent further outward movement. In this open position, the bumps 74 and 94 on the handles 61 and 81 overlie and overlap each other without becoming separated. As such, the overlap of the bumps 74 and 94 maintains the arms 12 and 13 in sliding contact during full scissored movement of the arms 12 and 13, and the overlap also prevents the arms 12 and 13 from coming out of such alignment. This prevents the arms 12 and 13 from jamming against each other during closing, as might happen without the overlap. Thus, in this position, the cutting edges 62 and 82 are advanced out beyond the mouth 25 and are apart from each other, defining a cutting space therebetween.

The user places a thread, line, or other fabric or material between the edges 62 and 82 and then squeezes the grips 70 and 90 together. This causes the blades 60 and 80 to close, thereby cutting the material between the edges 62 and 82. If additional snips are required, the user cyclically releases and squeezes the grips 70 and 90 according to conventional scissor use. When no further snips are required, the user squeezes the grips 70 and 90 together and then applies force on them in a rearward direction. This aligns and registers the notches 96 and 76 with the chocks 52 and 53 and causes the grips 70 and 90 and the arms 12 and 13 to slide backward. The arms 12 and 13, mounted on the post 48 of the guide 46, impart rearward movement of the guide 46 within the track 45 until the guide 46 is stopped at the rear of the track 45. The notches 96 and 76 are moved over the chocks 52 and 53, respectively, which are sized and shaped complementally. The chocks 52 and 53, having a rectangular shape, prevent inadvertent movement of the arms 12 and 13 outward away from each other, thereby locking the arms 12 and 13 in place in the retracted or stowed position, shown in FIG. 4. When the user wants to again use the device 10, he simply takes it up by hand and slides the arms 12 and 13 forward until they spring out from the housing 11.

The device 10 also includes the blade 14 carried in the head 35. The blade 14 is carried between the top and bottom housing 20 and 21, secured there by two pins 106 through the head 35 and the blade 14. A cutting edge 108 of the blade 14 is revealed in the opposed gaps behind the decks 32 and 33 and in front of the head 35. Fishing line, thread, or other items can be drawn into either of these gaps and then pulled so as to be drawn against the cutting edge of the blade 14, thereby cutting the item.

The device 10 also includes a clip 107 on the bottom housing 21 to allow the device 10 to be secured to pockets and articles of clothing. The clip 107 is constructed from a resilient spring metal or plastic and includes a long arm extending along the bottom housing 21 between the shoulders 30 and 31 and the mouth 25.

A preferred embodiment is fully and clearly described above so as to enable one having skill in the art to understand, make, and use the same. Those skilled in the art will recognize that modifications may be made to the description above without departing from the spirit of the specification, and that some embodiments include only those elements and features described, or a subset thereof. To the extent that modifications do not depart from the spirit of the specification, they are intended to be included within the scope thereof.

What is claimed is:

1. A cutting and snipping device, comprising:

a housing having a front, an opposed rear, an open mouth at the front, opposed sides extending from the front to the rear and each formed with longitudinal slots, and a head projecting from the rear, wherein a blade set into the head is exposed between the head and the rear of the housing;

scissor arms, each having a cutting edge at a front end, an opposed rear end, and a grip extending between the front end and the rear end; and the scissor arms are mounted within the housing for scissored movement with respect to each other and for reciprocal movement with respect to the housing between an advanced position in which the cutting edges are advanced out of the mouth and a retracted position in which the cutting edges are retracted within the mouth, wherein the scissors arms move among:

a first position of the scissor arms, in the retracted position thereof, wherein the grips are against the sides of the housing and the cutting edges of the scissor arms are within the mouth and overlap each other;

a second position of the scissor arms after the first position, in which the scissor arms are advanced out of the retracted position thereof, wherein the grips are against the sides of the housing and the cutting edges of the scissor arms are in front of the mouth and overlap each other; and a third position of the scissor arms after the second position, in which the scissor arms are in the advanced position thereof, wherein the grips are away from the sides of the housing and the cutting edges of the scissor arms are in front of the mouth, and the scissor arms are in an open position apart from each other.

2. The cutting and snipping device of claim 1, wherein the sides of the housing bow outwardly in a convex arrangement.

3. The cutting and snipping device of claim 1, further comprising:

two stop means within the housing, spaced apart from each other proximate the rear of the housing;

the scissor arms each have a notch at the rear ends, wherein the notch on one of the scissor arms is sized and shaped to receive one of the stop means, and the notch on the other of the scissor arms is size and shaped to receive another of the stop means;

when the scissor arms are in the retracted position and the stop means are received within the respective notches, the stop means disable the grips of the scissor arms from moving away from the sides of the housing in the scissored movement; and when the scissor arms are out of the retracted position and the stop means are out of the respective notches, the grips of the scissor arms are enabled to move away from the sides of the housing in the scissored movement.

4. The cutting and snipping device of claim 3, wherein:

each of the stop means comprises a chock; and the notches are recesses formed into the rear end of the scissor arms.

5. The cutting and snipping device of claim 4, wherein the chock and the notches are each rectangular.

6. The cutting and snipping device of claim 1, further comprising a post extending through the housing, proximate the rear thereof, wherein the scissor arms, being moveable along the scissored movement between open and closed positions with respect to each other, contact the post in the closed position thereof.

7. The cutting and snipping device of claim 1, further comprising:

an elongate track formed in the housing;

a guide carried in the track for movement between an advanced position associated with the scissor arms advanced position and a retracted position associated with the scissor arms retracted position, the guide comprising a base fit into the track and an upstanding post extending away from the base; and each of the scissor arms includes a hole through which the upstanding post extends, such that the scissor arms pivot in the scissored movement about the upstanding post and move in the reciprocal movement with the guide.

8. The cutting and snipping device of claim 7, further comprising a spring biasing the scissor arms toward the open position along the scissored movement, wherein the spring comprises a head disposed about the upstanding post and legs extending from the head rearward to holes where the legs are attached to the scissor arms.

9. A cutting and snipping device, comprising:

a housing having a front, an opposed rear, an open mouth at the front, opposed sides extending from the front to the rear and each formed with longitudinal slots, and a head projecting from the rear, wherein a blade set into the head is exposed between the head and the rear of the housing;

scissor arms, each having a cutting edge at a front end, an opposed rear end, and a grip extending between the front end and the rear end;

a first position of the scissor arms, in which the scissor arms are retracted toward the rear of the housing, the grips are against the sides of the housing, the cutting edges of the scissor arms are within the mouth and overlap each other;

a second position of the scissor arms after the first position, in which the scissor arms are advanced away from the rear of the housing, the grips are against the sides of the housing, the cutting edges of the scissor arms are in front of the mouth and overlap each other; and a third position of the scissor arms after the second position, in which the scissor arms are advanced away from the rear of the housing, the grips are away from the sides of the housing, the cutting edges of the scissor arms are in front of the mouth and are apart from each other.

10. The cutting and snipping device of claim 9, wherein the sides of the housing bow outwardly in a convex arrangement.

11. The cutting and snipping device of claim 9, further comprising:

two stop means within the housing, spaced apart from each other proximate the rear of the housing;

the scissor arms each have a notch at the rear ends, wherein the notches are sized and shaped to receive the stop means;

when the stop means are received within the notches in the first position of the scissor arms, the stop means prevent the grips of the scissor arms from moving away from the sides of the housing; and when the stop means are out of the notches in the third position of the scissor arms, the stop means allow the grips of the scissor arms to move away from the sides of the housing.

12. The cutting and snipping device of claim 11, wherein:

each of the stop means comprises a chock; and the notches are recesses formed into the rear end of the scissor arms.

13. The cutting and snipping device of claim 12, wherein the chock and the notches are each rectangular.

14. The cutting and snipping device of claim 9, further comprising a post extending through the housing, proximate the rear thereof, wherein the scissor arms, being moveable between open and closed positions with respect to each other, contact the post in the closed position thereof.

15. The cutting and snipping device of claim 9, further comprising:

an elongate track formed in the housing;

a guide carried in the track for movement between an advanced position and a retracted position, the guide comprising a base fit into the track and an upstanding post extending away from the base; and each of the scissor arms includes a hole through which the upstanding post extends, such that the scissor arms pivot in scissored movement about the upstanding post and move in reciprocal movement with the guide.

16. The cutting and snipping device of claim 15, further comprising a spring biasing the scissor arms into an open position in the third position of the scissor arms, wherein the spring comprises a head disposed about the upstanding post and legs extending from the head rearward to holes where the legs are attached to the scissor arms.

17. A cutting and snipping device, comprising:

a housing have a front, an opposed rear, an open mouth at the front, opposed sides extending from the front to the rear and each formed with longitudinal slots, and a head projecting from the rear, wherein a blade set into the head is exposed between the head and the rear of the housing;

the sides of the housing bow outwardly in a convex arrangement;

scissor arms, each having a cutting edge at a front end, an opposed rear end, and a grip extending between the front end and the rear end;

a first position of the scissor arms, in which the scissor arms are retracted toward the rear of the housing, the grips are against the sides of the housing, the cutting edges of the scissor arms are within the mouth and overlap each other;

a second position of the scissor arms after the first position, in which the scissor arms are advanced forward away from the rear of the housing, the grips are against the sides of the housing, the cutting edges of the scissor arms are in front of the mouth and overlap each other; and a third position of the scissor arms after the second position, in which the scissor arms are advanced forward away from the rear of the housing, the grips are away from the sides of the housing, the cutting edges of the scissor arms are in front of the mouth and are apart from each other.

18. The cutting and snipping device of claim 17, wherein the scissor arms are moveable between open and closed positions in the third and second positions, respectively, to move the cutting edges away from and toward each other.

19. The cutting and snipping device of claim 17, further comprising:

two stop means within the housing, spaced apart from each other proximate the rear of the housing;

the scissor arms each have a notch at the rear ends, wherein the notches are sized and shaped to receive the stop means;

in the first position of the scissor arms, the stop means are received within the notches and prevent the grips of the scissor arms from moving away from the sides of the housing; and in the second and third positions of the scissor arms, the stop means are out of the notches and allow the grips of the scissor arms to move away from the sides of the housing.

20. The cutting and snipping device of claim 19, wherein:

each of the stop means comprises a chock; and the notches are recesses formed into the rear end of the scissor arms.

21. The cutting and snipping device of claim 20, wherein the chock and the notches are each rectangular.

22. The cutting and snipping device of claim 17, further comprising a post extending through the housing, proximate the rear thereof, wherein the scissor arms, being moveable between open and closed positions with respect to each other, contact the post in the closed position thereof.

23. The cutting and snipping device of claim 17, further comprising:

an elongate track formed in the housing;

a guide carried in the track for movement between an advanced position and a retracted position, the guide comprising a base fit into the track and an upstanding post extending away from the base; and each of the scissor arms includes a hole through which the upstanding post extends, such that the scissor arms pivot in scissored movement about the upstanding post and move in reciprocal movement with the guide.

24. The cutting and snipping device of claim 23, further comprising a spring biasing the scissor arms into an open position in the third position of the scissor arms, wherein the spring comprises a head disposed about the upstanding post and legs extending from the head rearward to holes where the legs are attached to the scissor arms.

* * * * *